US009010495B2

(12) United States Patent
Prasad et al.

(10) Patent No.: US 9,010,495 B2
(45) Date of Patent: Apr. 21, 2015

(54) SHEAVE FOR USE IN AN ELEVATOR SYSTEM

(75) Inventors: Dilip Prasad, Vernon, CT (US); Brice N. Cassenti, Tolland, CT (US); Pedro S. Baranda, Alcabideche (PT); William Veronesi, Hartford, CT (US); William C. Perron, Burlington, CT (US); Ary O. Mello, Jr., Farmington, CT (US); Paul A. Stucky, Stockton, CA (US); John T. Pitts, Avon, CT (US); John P. Wesson, Vernon, CT (US); Mark S. Thompson, Tolland, CT (US)

(73) Assignee: Otis Elevator Company, Farmington, CT (US)

( * ) Notice: Subject to any disclaimer, the term of this patent is extended or adjusted under 35 U.S.C. 154(b) by 2245 days.

(21) Appl. No.: 11/572,236

(22) PCT Filed: Aug. 4, 2004

(86) PCT No.: PCT/US2004/025211

§ 371 (c)(1),
(2), (4) Date: Jan. 17, 2007

(87) PCT Pub. No.: WO2006/022686

PCT Pub. Date: Mar. 2, 2006

(65) Prior Publication Data

US 2007/0252121 A1 Nov. 1, 2007

(51) Int. Cl.
*B66B 11/08* (2006.01)
*B66B 15/04* (2006.01)
(Continued)

(52) U.S. Cl.
CPC ..... *B66B 15/04* (2013.01); *B66B 11/08* (2013.01); *B66D 3/04* (2013.01); *B66D 2700/026* (2013.01)

(58) Field of Classification Search
CPC ..... B66D 3/04; B66B 15/04
USPC ..... 187/251, 254, 414, 266; 57/105; 254/390, 393, 902; 474/63, 118, 135, 474/138–139, 166–167; 74/63; 242/118, 242/118.2, 322, 903
See application file for complete search history.

(56) References Cited

U.S. PATENT DOCUMENTS 489,323 A 1/1893 Noble et al.
1,592,418 A 4/1926 Brownell
(Continued)

FOREIGN PATENT DOCUMENTS

FR 580601 11/1924
JP 622514 1/1987

OTHER PUBLICATIONS

Abramowitz et al, Handbook of Mathematical Functions, Jun. 1964, National Bureau of Standards, vol. 55, p. 14.*
(Continued)

*Primary Examiner* — William A Rivera
*Assistant Examiner* — Stefan Kruer
(74) *Attorney, Agent, or Firm* — Carlson, Gaskey & Olds

(57) ABSTRACT

An elevator sheave (20) includes a belt guiding surface (26) having a surface profile along at least a portion of the belt guiding surface. The surface profile preferably is defined by an $n^{th}$ order polynomial equation where n is a number greater than 2. In one example, the reference point (40) is a central point along the width of the belt guiding surface (26). In one example, a central portion (42) of the surface profile preferably is aligned to be generally parallel with the central axis (34) of the sheave body. Some examples have curvilinear side portions (44,46) between the central portion (42) and the edges (28,30) of the sheave. Other examples also include second side portions (48,50) that have linear profiles.

15 Claims, 2 Drawing Sheets

(51) Int. Cl.
*B66B 11/00* (2006.01)
*B66D 3/04* (2006.01)

(56) References Cited

U.S. PATENT DOCUMENTS

| | | | | | |
|---|---|---|---|---|---|
| 2,274,512 | A | | 7/1941 | Weimer | |
| 2,966,065 | A | * | 12/1960 | Renner | 198/832 |
| 3,066,794 | A | * | 12/1962 | Mulheren et al. | 242/160.1 |
| 3,288,338 | A | | 11/1966 | Morrow | |
| 3,789,682 | A | | 2/1974 | Holz | |
| 3,851,535 | A | | 12/1974 | Presentey | |
| 4,586,915 | A | * | 5/1986 | Cathey et al. | 474/205 |
| 4,718,520 | A | | 1/1988 | Schroder | |
| 4,991,784 | A | * | 2/1991 | Schmid | 242/390.3 |
| 4,995,855 | A | * | 2/1991 | Hasebe et al. | 474/167 |
| 5,002,157 | A | | 3/1991 | Heikkinen | |
| 5,382,761 | A | | 1/1995 | Amano | |
| 5,411,444 | A | | 5/1995 | Nakamura et al. | |
| 5,870,924 | A | * | 2/1999 | Fahimi et al. | 72/379.2 |
| 6,041,476 | A | | 3/2000 | deNormand | |
| 6,206,796 | B1 | * | 3/2001 | Lee | 474/84 |
| 6,371,448 | B1 | | 4/2002 | De Angelis | |
| 6,401,871 | B2 | | 6/2002 | Baranda et al. | |
| 6,416,433 | B1 | | 7/2002 | Linnenbrugger | |
| 6,419,208 | B1 | * | 7/2002 | Baranda et al. | 254/390 |
| 6,488,123 | B2 | | 12/2002 | Pitts et al. | |
| 2004/0256180 | A1 | * | 12/2004 | Eichhorn et al. | 187/254 |
| 2005/0266947 | A1 | * | 12/2005 | Miyata | 474/148 |
| 2010/0236869 | A1 | * | 9/2010 | Fargo et al. | 187/251 |

OTHER PUBLICATIONS

PCT International Search Report for International Application No. PCT/US04/25211, dated Sep. 28, 2006.

PCT Written Opinion of the International Searching Authority for International Application No. PCT/US04/25211 dated Sep. 28, 2006.

PCT International Preliminary Report on Patentability relating to International Application No. PCT/US2004/025211 mailed Feb. 15, 2007.

Extended European Search Report for Application No. EP 12 15 7343 mail Mar. 29, 2012.

* cited by examiner

SHEAVE FOR USE IN AN ELEVATOR SYSTEM

FIELD OF THE INVENTION

This invention generally relates to elevator sheaves and more particularly, to a unique belt guiding surface configuration on an elevator sheave.

DESCRIPTION OF THE RELATED ART

Elevator systems are widely known and used. Typical arrangements include an elevator cab that moves between landings in a building, for example to transport passengers or cargo to different levels in the building. A load bearing member, such as a rope or a belt typically supports the weight of the cab as it moves through the hoistway.

As the cab moves through the hoistway, the load bearing member typically moves over at least one sheave. In some instances the sheave is a drive sheave, which is coupled to a motorized mechanism for moving the elevator cab as desired. In other instances, sheaves are passive and move responsive to movement of the load bearing member.

While elevator sheaves have been in use for a long time, there is a need for an improvement in their design to maximize the longevity of the elevator system components, such as the load bearing member. For example, flat belts typically are subjected to overload stresses as the belt moves over the sheave. Additionally, because the elevator sheave axis is typically not perfectly aligned with the supporting mechanism axis, there is a tendency for the belt to move sideways along the sheave as the sheave rotates. While crowned sheave surfaces have been used to improve belt-tracking behavior, they have the associated drawback of introducing an overload in at least some of the cords in the central region of the belt. Coated steel belts in which a plurality of steel cords are imbedded in a polymer coating are particularly subject to such strain because those belts are designed to be axially very stiff. The cords are not uniformly stressed, resulting in uneven loading. Additionally, conventional crown designs do not adequately accommodate tracking behavior under all circumstances.

There is a need for an improved elevator sheave design that optimizes tracking performance of the load bearing member and reduces overall stress on the load bearing member. This invention addresses that need while avoiding the shortcomings and drawbacks of the prior art.

SUMMARY OF THE INVENTION

An exemplary disclosed sheave for use in an elevator system has a belt guiding surface that maximizes tracking capabilities while minimizing stress induced on the load bearing member.

An example sheave includes a sheave body that has a central axis about which the sheave rotates. A belt guiding surface includes a surface profile extending along at least a portion of the belt guiding surface. The surface profile preferably is defined by an equation that approximates an $n^{th}$ degree polynomial, of a distance from a selected reference point on the belt guiding surface, where n is a number greater than 2.

In one example, the belt guiding surface includes a central portion that is aligned parallel with the central axis of the sheave. Side portions on either side of the central portion preferably are defined by an equation that approximates an $n^{th}$ degree polynomial of a distance from a selected reference point on the belt guiding surface, where n is any number. The latter example is particularly useful for embodiments where the width of the load bearing member or belt is greater than one-half of the width of the belt guiding surface.

In another example, first side portions on either side of the central portion are defined by an $n^{th}$ degree polynomial. Second side portions extend from the first side portions toward outer edges of the sheave. The second side portions in this example have a linear profile. Accordingly, a sheave designed according to this example provides three distinct zones on each side of a plane of symmetry through a center of the sheave.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
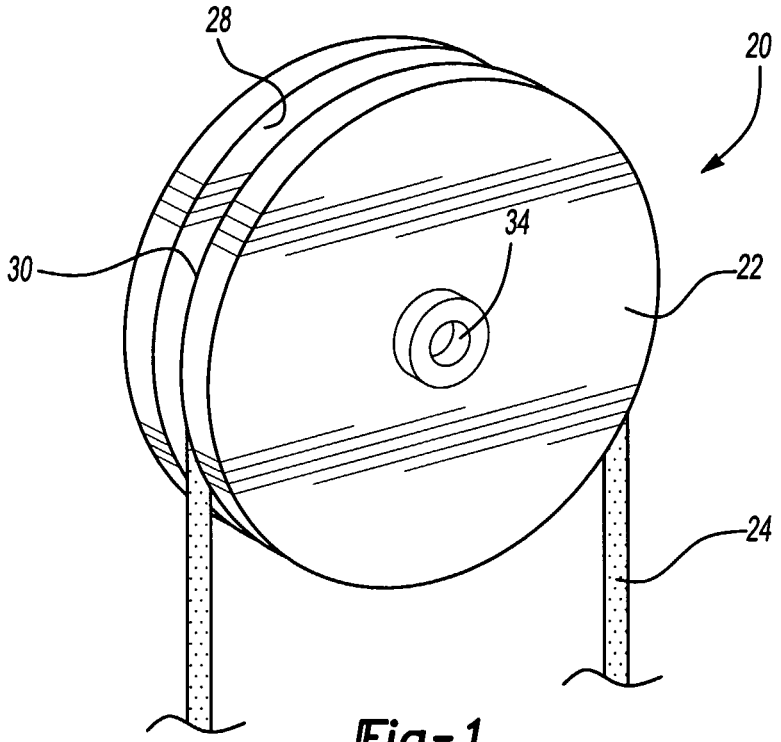
FIG. 1 diagrammatically illustrates an elevator sheave assembly designed according to an embodiment of this invention.

FIG. 1 diagrammatically illustrates an elevator sheave assembly 20 where a sheave body 22 cooperates with a load bearing member 24. The load bearing member 24 in one example is a coated steel belt. The term "belt" as used in this description should not be construed in its strictest sense. An assembly designed according to this invention may accommodate flat belts, coated steel belts, or other synthetic core belts used in elevator systems. The term "belt," therefore, should be construed in a generic sense to include a variety of configurations of load bearing members useful in an elevator system.

Figure 2:
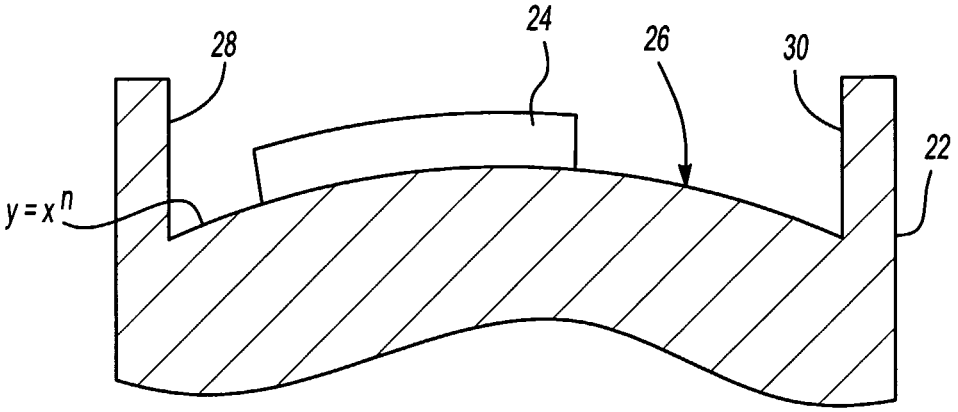
FIG. 2 is a partial cross sectional illustration of the embodiment of FIG. 1.

The belt 24 is received upon a belt guiding surface 26 that extends between edges 28 and 30 on the illustrated sheave. The raised edges 28 and 30 are not included in another example sheave. The belt rides along the surface 26 as the sheave rotates about a central axis 34. The belt guiding surface preferably includes a surface profile along at least a portion of the width of the belt guiding surface. The surface profile preferably provides an at least partially crowned surface along which the belt rides on the sheave. As can be appreciated from FIG. 2, the belt guiding surface 26 includes a surface profile that extends in an axial direction and is at least partially convex as seen in a radial cross section of the sheave 22.

In one example, the surface profile is approximated by a higher order polynomial equation. This equation may be expressed as $y=|x^n|$ where n is a number greater than 2, y is along an axis perpendicular to the sheave axis of rotation 34 and x is a distance measured from a reference point 40 on the belt guiding surface 26 in a direction parallel to the sheave axis of rotation. In the illustrated example, the reference point 40 is at a central location along the width of the belt guiding surface 26.

The example surface profiles maximize the tracking behavior of the belt 24 on the belt guiding surface 26 while minimizing the stresses on the belt caused by the shape of the profile. The example surface profiles enhance tracking robustness because they maintain adequate spacing between the edges on a belt and the sides of the sheave.

Figure 3:
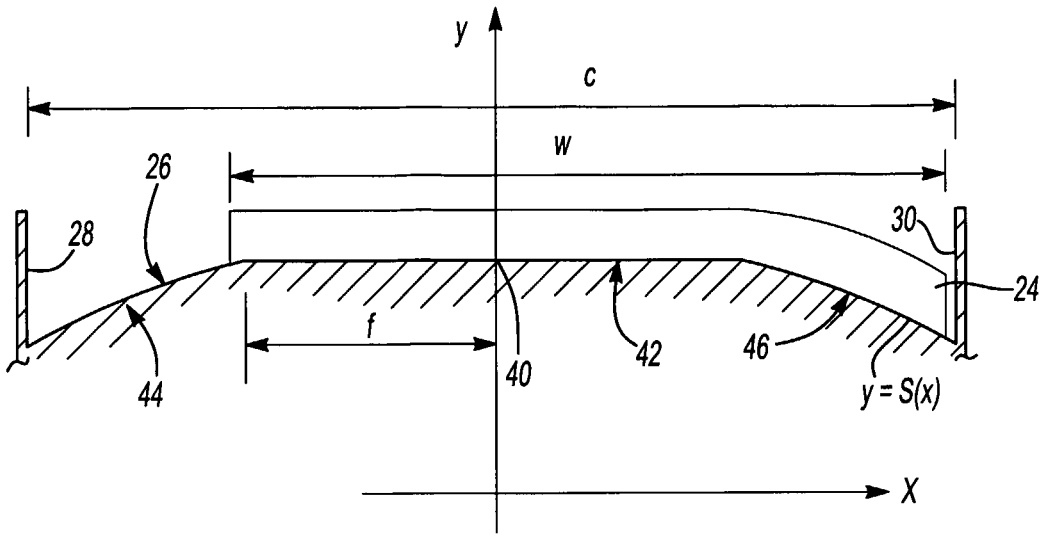
FIG. 3 illustrates selected features of an embodiment of this invention.

In examples as shown in FIG. 3, where the width w of the belt 24 is greater than one-half the width c of the belt guiding surface 26, the surface profile preferably includes a flat central portion 42. A distance between each point along the central portion 42 and the central axis 34 is equal in the illustrated example. In other words, the example central portion 42 preferably is aligned entirely parallel with the central axis 34 of the sheave 22.

Side portions 44 and 46 of the surface profile preferably extend between the central portion 42 and the edges 28 and 30 of the belt guiding surface, respectively. Each of the side portions 44 and 46 preferably is approximated by the equation $y=x^n$ where n is any number. In the example of FIG. 3, n=2. In one example, the surface 26 has various sections with different n values. In another example, the surface 26 has portions with different n values on each side of the center of the surface 26 such that the surface 26 is asymmetric about the center.

A crown design as shown in FIG. 3 preferably is flat along the section of the top of the crown that cannot be accessed by the trailing edge of the belt 24. The width of the central portion 42 preferably is equal to twice the difference between the width w of the belt 24 and one-half the width c of the belt guiding surface 26 (e.g., $2\times(w-c/2)$). The distance f indicated in FIG. 3 preferably is equal to w-c/2 (e.g., the distance f is one-half the width of the central portion 42 in this example). Therefore, whenever there is spacing between the edges of the belt 24 and the edges 28 and 30 of the sheave, respectively, neither belt edge will be on the flat central portion 42.

Figure 4:
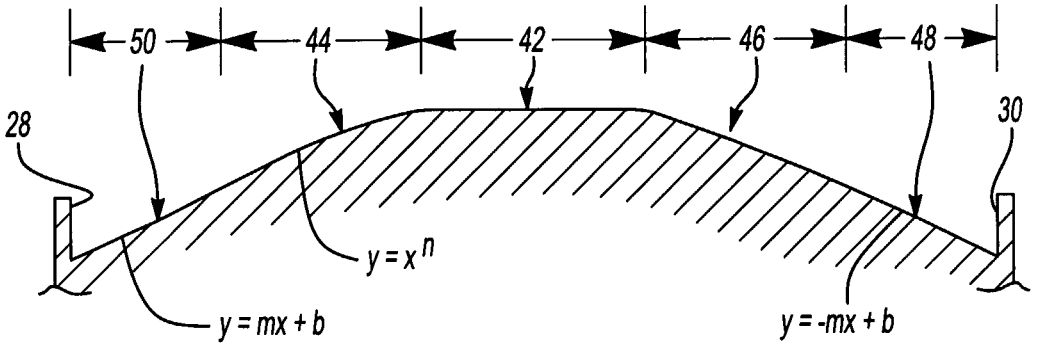
FIG. 4 schematically illustrates another example embodiment.

FIG. 4 illustrates another example where the belt guiding surface 26 has a central portion 42 that is aligned parallel with the sheave axis of rotation 34. First side portions 44 and 46 extend away from opposite sides of the central portion 42. In this example, the first side portions 44 and 46 have a profile described by an $n^{th}$ order polynomial, where n is any number. In one particular example, n is greater than 2. In this example, the first side portions 44 and 46 do not extend all the way toward ends 28 and 30 of the sheave.

Second side portions 48 and 50 extend between the first side portions 46 and 44, respectively, and the edges of the belt guiding surface 26. In this example, the second side portions 48 and 50 have a surface profile that is linear. In the illustrated example, the belt guiding surface 26 is symmetrical about a plane through a center of the sheave (i.e., a vertical plane extending into the page).

In examples as shown in FIG. 4, the second side portions 50 and 48 preferably are linear. Having a linear profile section near the edges of the belt guiding surface 26 maintains the tracking efficiency of an arrangement having a curved surface extending between the central portion and the edges of the belt guiding surface 26. Having a linear profile, however, reduces the effect of the curved surface that would tend to compromise the service life of the belt without limiting the tracking efficiency of the most outward portions of the belt guiding surface 26. This is accomplished, in part, because the loads on the portions of the belt riding over the outermost portions of the belt guiding surface 26 carry significantly lower loads than the portions of the belt riding over the central portion 42 and the more central areas of the first side portions 44 and 46.

In the figures, transitions between portions of the guiding surfaces 26 are somewhat exaggerated for illustration. In an example sheave, the guiding surface is machined from a single piece of material and presents a continuous, uninterrupted surface across the entire sheave.

The preceding description is exemplary rather than limiting in nature. Variations and modifications to what has been disclosed above may become apparent to those skilled in the art that do not necessarily depart from the essence of this invention. The scope of legal protection given to this invention can only be determined by studying the following claims.

We claim:

1. A sheave for use in an elevator system, comprising:

a sheave body having a central axis and a crowned belt guiding surface including a selected reference point the crowned belt guiding surface including a surface profile extending in an axial direction along at least a portion of the belt guiding surface, the surface profile defined as an $n^{th}$ degree polynomial of a distance from the selected reference point on the belt guiding surface where n is a number greater than 2.

2. The sheave of claim 1, including a central portion of the surface profile that has a width and is aligned parallel to the central axis.

3. The sheave of claim 2, wherein the central portion is entirely equally distant from the central axis.

4. The sheave of claim 2, including first side portions on opposite sides of the central portion, wherein the first side portions have a surface profile defined by the $n^{th}$ degree polynomial, and including second side portions extending from the first side portions toward edges of the belt guiding surface, the second side portions having a linear profile.

5. The sheave of claim 2, wherein the central portion has a profile that is distinct from the $n^{th}$ degree polynomial profile.

6. The sheave of claim 1, including a first edge of the surface profile spaced a first nominal distance from the central axis and wherein the reference point is spaced a second distance from the central axis that is greater than the first distance.

7. The sheave of claim 6, including a central portion of the surface profile having a width and an equal distance to the central axis along the entire central portion.

8. An assembly for use in an elevator system, comprising:

a belt having a width; and a sheave that supports the belt and is rotatable about a central axis as the belt moves, the sheave including a crowned belt guiding surface having a width that extends between edges on opposite sides of the sheave, the entire belt guiding surface being a single piece of material that presents a continuous, uninterrupted surface, the belt guiding surface having a central portion that has a width across which the belt guiding surface is aligned parallel to the central axis so as to be at least partially equidistant from the central axis, and side portions extending from the central portion toward corresponding edges of the sheave that are curved relative to the central axis, wherein the width of the central portion of the belt guiding surface is equal to approximately two times the difference between the belt width and one-half the width of the belt guiding surface.

9. The assembly of claim 8, wherein the central portion extends in opposite directions from a center point on the belt guiding surface and one-half of the central portion is on each side of the center point.

10. The assembly of claim 8, wherein the side portions of the belt guiding surface each have a curvature defined by an $n^{th}$ order polynomial of a selected reference point on the belt guiding surface.

11. The assembly of claim 8 wherein the entire central portion is equally spaced from the central axis and the distance between the central portion and the central axis is greater than the distance between the central axis and any point along the side portions.

12. The assembly of claim 8 wherein the belt width is greater than one-half the width of the belt guiding surface.

13. The assembly of claim 8 including second side portions extending from the side portions toward the corresponding edges of the sheave, the second side portions having a surface profile that is linear.

14. A sheave for use in an elevator system, comprising:

a sheave body have a central axis and a crowned belt guiding surface including a selected reference point, the crowned belt guiding surface including a surface profile extending in an axial direction along at least a portion of the belt guiding surface, the surface profile having a central portion, first side portions extending away from opposite edges of the central portion toward corresponding edges of the sheave and second side portions extending away from the first side portions toward the corresponding edges of the sheave, the central portion having a width across which the surface profile has a parallel alignment with the sheave central axis, the first side portions having a curved profile and the second side portions have a linear profile, wherein the first side portions have a surface profile defined as an $n^{th}$ degree polynomial of a distance from the selected reference point on the belt guiding surface, wherein n is a number greater than two.

15. The sheave of claim 14, wherein the entire central portion is equally distant from the sheave central axis.

* * * * *